United States Patent [19]

Gaitten, deceased

[11] Patent Number: 4,506,713

[45] Date of Patent: Mar. 26, 1985

[54] DEBARKING MACHINE WITH FEED ROLLS HAVING ELONGATED MEMBERS ACCOMMODATING LATERAL MOVEMENT

[75] Inventor: Walden M. Gaitten, deceased, late of Sylacauga, Ala., by Dorothy A. Gaitten, executrix

[73] Assignee: Kockums Cancar, Corp., Talladega, Ala.

[21] Appl. No.: 559,817

[22] Filed: Dec. 9, 1983

[51] Int. Cl.[3] ..... B27L 1/00

[52] U.S. Cl. ..... 144/208 E; 144/246 F; 198/624

[58] Field of Search ..... 144/208 E, 246 R, 246 C, 144/246 F; 198/624, 692, 625

[56] References Cited

U.S. PATENT DOCUMENTS

| | | | |
|---|---|---|---|
| 2,857,945 | 10/1958 | Brundell et al. . | |
| 2,860,672 | 11/1958 | Brundell et al. . | |
| 2,875,715 | 3/1959 | Reece . | |
| 2,893,453 | 7/1959 | Brundell et al. . | |
| 2,897,859 | 8/1959 | Annis, Jr. | 144/246 F |
| 2,903,027 | 9/1959 | Edgemond, Jr. et al. . | |
| 3,171,455 | 3/1965 | Brundell et al. . | |
| 3,228,439 | 1/1966 | Jonsson et al. . | |
| 4,257,461 | 3/1981 | Wangeby et al. | 144/246 F |

*Primary Examiner*—W. D. Bray

*Attorney, Agent, or Firm*—Cushman, Darby & Cushman

[57] ABSTRACT

An improvement in a debarking machine of the type including an annular frame, a plurality of debarking tools mounted in annularly spaced relation within the annular frame for rotation together about the axis of the annular frame and for movement toward and away from each other, infeed and outfeed mechanisms for feeding logs through the annular frame so that the tools will engage the exterior periphery of the successive logs and strip the bark therefrom during their movement through the annular frame. The infeed mechanism includes three driven infeed spiked rolls arranged so that their spiked peripheries normally engage the exterior periphery of the log in centered relation and move the same axially through the annular frame for debarking by the tools. Each of the spiked rolls includes a cylinder and a multiplicity of spikes extending radially outwardly therefrom. The improvement comprises providing at least one of the infeed rolls with an elongated member (preferably three) secured to and extending substantially transversely across the exterior periphery of the cylinder thereof and defining a substantially continuous log penetrating surface disposed generally in the plane of the outer ends of said spikes. The log penetrating surface of each elongated member is configured to penetrate a log engaged thereby to an extent less than the penetration of the log by the spikes of the associated roll so that another roll cooperatively engaging the log serves to effect a transverse centering movement of the log along the elongated member while engaged thereby.

7 Claims, 5 Drawing Figures

DEBARKING MACHINE WITH FEED ROLLS HAVING ELONGATED MEMBERS ACCOMMODATING LATERAL MOVEMENT

This invention relates to debarking machines and more particularly to improvements in debarking machines of the type described in U.S. Pat. No. 2,857,945 issued Oct. 28, 1958 to P. G. Brundell et al.

Brundell et al. patent discloses an annular frame having mounted on the central portion thereof a plurality of tools capable of moving radially inwardly and outwardly toward and away from one another while being rotated together about the axis of the annular frame. At the inlet side of the frame there are provided three infeed rolls of a construction which includes a multiplicity of conical spikes extending outwardly from a cylindrical periphery. The rolls are mounted on the annular frame for pivotal movement together toward and away from one another about axes which are parallel with the longitudinal axis of the annular frame. The rotational axis of each roll extends perpendicular to its pivotal axis. At the outfeed side of the annular frame there are provided three outfeed rolls of similar conical spike configuration mounted about the same pivotal axes as the infeed rolls and having their axes of rotation perpendicular to their pivotal axis. Each set of three rolls is normally spring urged into an innermost position and are movable outwardly in response to engagement of a log end therewith. As the infeed rolls move the log through the central portion of the annular frame, the tools are likewise moved away from one another. In operation, the tools are normally urged to move inwardly so as to press against the surface of the log being debarked with an intensity such that the tips penetrate the bark and continuously ride on the wood surface of the log despite irregularities of log contour and bark. A wood contacting edge of each tool tip is sufficiently blunt so as not to unduly damage the wood. As the leading end of the log moves into the outfeed side of the annular frame having been debarked, it engages the outfeed rollers which move apart to accommodate the periphery of the log and then serve to feed the log axially outwardly.

While the Brundell et al. debarker has proven to be an effective piece of equipment in operation, one problem which is presented in the normal operation of the devices relates to the automatic conveying of the logs to the infeed mechanism of the debarker. Standard practice is to provide a deck for receiving the logs having a kick and hold mechanism or a stop and loading mechanism. These mechanisms serve to move successive logs onto a feeding conveyor which supports the logs and moves them into the infeed roll mechanism of the debarker machine. Typically a feeding conveyor is constructed of conical rolls, although chain-trough type conveyors are used as well.

The feeding conveyors support the logs and move the same into the infeed rolls of the debarker machine automatically. A problem is sometimes presented when the log being fed by the feeding conveyor has an offset end. In the case of chain-trough type feeding this problem can be exaggerated when smaller logs are fed because of the greater possibility of the smaller logs being fed somewhat off-center. Where logs are fed to the debarking machine in off-center relation, the construction and operation of the infeed mechanism of the debarker machine is such as to tend to continue the feed of the log through the machine in an off-center relationship. Where the log is moved through the annular frame in an off-center relationship, there is considerably greater difficulty encountered in the operation of the tools and it sometimes happens that the bark will not be completely removed, or unwanted removal takes place. Characteristically when a log is fed through the annular frame in off-center relationship, it is usually the case that the log will be gripped only between two of the three spiked infeed rolls rather than all three. While the operation of the tools and the outfeed rolls, as well as the relative position of the infeed rolls, tend to bias the log into centered relation, nevertheless the penetration of the spikes of two cooperating infeed rolls within the log periphery has a more than balancing tendency to prevent the log from moving laterally once it is in gripping relation between the two cooperating rolls.

It is an object of the present invention to provide improvements in the infeed mechanism of debarking machines of the type described which will obviate the problems noted above and facilitate the lateral movement of a log when disposed in gripping engagement between two of the infeed rolls. In accordance with the principles of the present invention this objective is obtained by providing at least one of the infeed rolls with an elongated member which is secured to and extends substantially transversely across the exterior periphery of the cylinder thereof and defines a substantially continuous log penetrating surface disposed generally in the plane of the outer ends of the spikes of the roll. The log penetrating surface of the elongated member is configured to penetrate a log engaged thereby to an extent less than the penetration of the log by the spikes of the associated roll so that another roll cooperatively engaging the log will serve to effect a transverse centering movement of the log along the elongated member while engaged thereby.

Preferably, the plurality of annularly spaced elongated members is secured to the cylinder of the aforesaid infeed roll. Preferably there are three such elongated members which may extend either straight across or in helically shaped configuration. Preferably the elongated member is formed of an angle iron.

Accordingly, it is another object of the present invention to provide a debarking machine of the type described having at least one infeed roll formed with elongated members which function to facilitate lateral movement of an off-center log into centered relation.

These and other objects of the present invention will become more apparent during the course of the following detailed description and appended claims.

The invention may best be understood with reference to the accompanying drawings, wherein an illustrative embodiment is shown.

Figure 1:
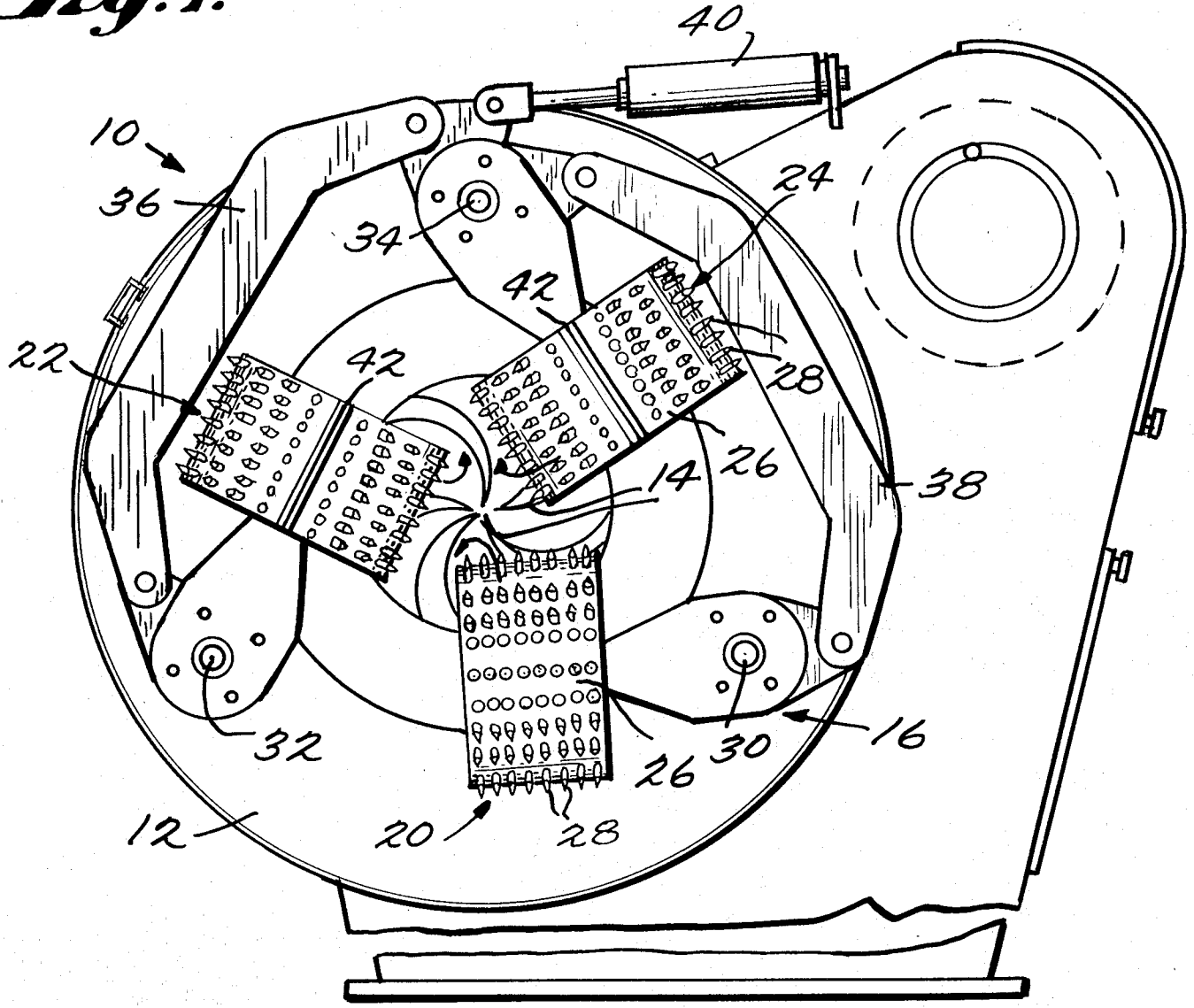
FIG. 1 is a front elevational view of a debarking machine embodying the principles of the present invention.
Figure 2:
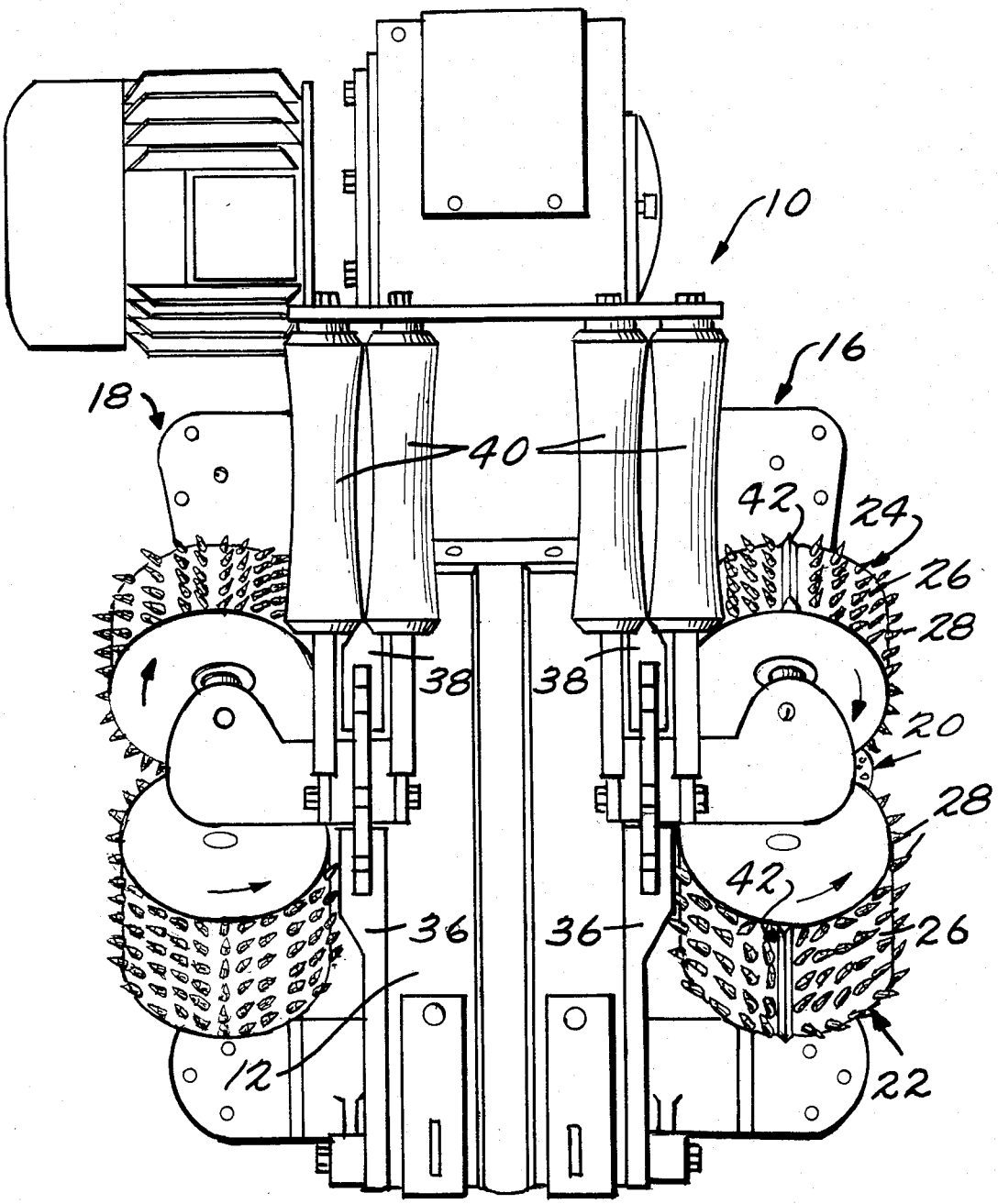
FIG. 2 is a side elevational view of the debarking machine shown in FIG. 1.
Figure 3:
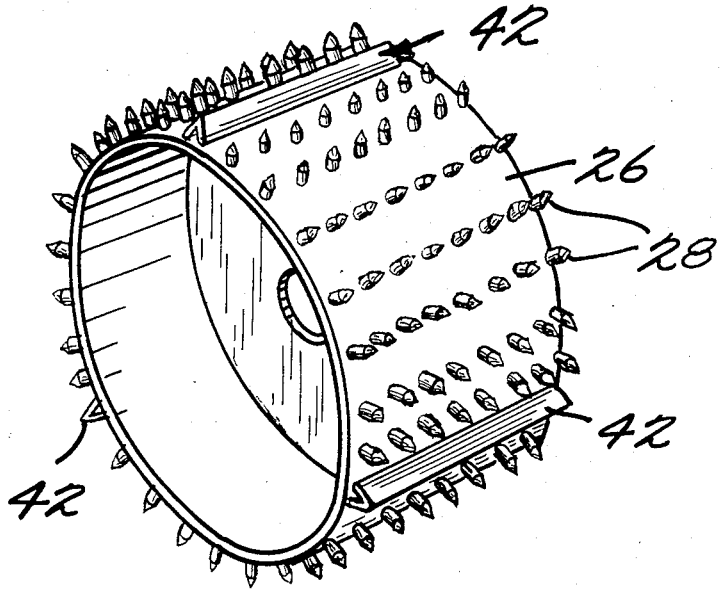
FIG. 3 is a perspective view of an infeed roll having a preferred form of lateral movement facilitating means provided thereon.

Referring now more particularly to FIGS. 1 and 2, there is shown therein a debarking machine, generally indicated at 10, which has embodied therein the improvements of the present invention. As previously indicated, the debarking machine is preferably of the type disclosed in commonly-assigned U.S. Pat. No. 2,857,945, the disclosure of which is hereby incorporated by reference into the present specification. Other related patents disclosing variations in the debarking machine include the following, the disclosure of each of which is hereby incorporated by reference into the present specification: U.S. Pat. Nos. 2,875,715; 2,860,672; 2,893,453; 2,903,027; 3,171,455; and 3,228,439.

The improvements of the present invention relate specifically to one of the basic components of the debarking machine and consequently the present specification will be concerned with the details of construction of the improvements and how they relate to the basic component in which they are embodied and how the improvements enhance the operative relationship between the improved components and the other basic components of the debarking machine. Consequently, the details of construction of the other components of the machine will not be specifically described, it being understood that reference may be had to any of the above-noted patents in order to obtain whatever detailed understanding is required.

The basic components of the debarking machine include an annular frame assembly, generally indicated at 12. Mounted within the annular frame assembly 12 for rotation together about the axis of the annular frame and for movement toward and away from each other is a plurality of annularly spaced debarking tools 14. The tools 14 are normally biased into their innermost position and are capable of moving outwardly in response to the engagement of a log end therewith so that the inner cutting ends of the tools will engage the periphery or bark of a log passing therethrough and remove the same as the tools are rotated together about the axis of the annular frame.

An infeed mechanism, generally indicated at 16, and an outfeed mechanism, generally indicated at 18, are provided on opposite sides of the annular frame assembly for feeding successive logs through the annular frame so that the tools will engage the exterior periphery of successive logs and strip the bark therefrom during their movement through the annular frame.

The outfeed mechanism 18 is similar in construction and operation with the infeed mechanism 16. The improvements of the present invention are embodied in the infeed mechanism 16 and consequently the details of construction of this mechanism will be recited with the understanding that the outfeed mechanism is similarly constructed except for the provision of the improvements of the present invention, although the improvements may be provided on the outfeed rolls as well, if desired.

As shown in FIGS. 1 and 2 of the drawings, the infeed mechanism 16 includes three feed rolls, 20, 22 and 24. Each of the feed rolls is constructed similarly of a cylindrical member 26 having a multiplicity of spikes 28 suitably fixed to the exterior periphery thereof, as by welding or the like. As shown, the multiplicity of spikes 28 associated with each infeed roll cylinder 26 is positioned in annularly spaced transversely extending rows. As shown, each spike 28 is provided with a conical point. However, it will be understood that the spikes can be constructed in accordance with the teachings of my commonly-assigned application, Ser. No. 559,815, filed concurrently herewith, entitled "FEED ROLL SPIKES WITH PLUS-SHAPED CUTTING EDGES".

It will be understood that each of the infeed rolls 20, 22 and 24 is power driven for rotational movement about the axis of the associated cylinder 26. In this regard it will be noted that the axes of the cylinders are disposed within a common plane which is perpendicular to the axis of the annular frame 12. Moreover, the three infeed rolls are positioned so that roll 20 has its axis disposed below the axis of the annular frame 12. The infeed roll 20 is power driven in a direction such that its upper periphery moves in a direction toward the tools 14 as indicated by the arrow shown in FIG. 1. The infeed rolls 22 and 24 are positioned in corresponding equally annularly spaced relation about the axis of the annular frame and each is power driven so that the spikes on the periphery thereof move inwardly toward the tools as they reach the closest position toward the axis of the annular frame. Stated differently, the three infeed rolls are power driven to rotate in a direction to cooperatively engage the periphery of a log and feed the same in a direction toward the tools 14 and through the annular frame 12 in generally coaxial relation therewith.

The infeed rolls 20, 22 and 24 are also mounted on the annular frame for simultaneous swinging movement about annularly spaced axes 30, 32 and 34 respectively, so that the cooperating log engaging spiked peripheries thereof will move toward and away from one another or toward and away from the axis of the annular frame 12. In order to effect simultaneous pivotal movement of the three infeed rolls, a pair of connecting links 36 and 38 is provided which extend respectively between the rolls 22 and 24, and rolls 24 and 20. In accordance with the teachings contained in the Brundell et al. patent, a pair of spring devices 40 is connected between the annular frame assembly 12 and the infeed roll 24 so as to resiliently bias roll 24 together with rolls 20 and 22 into their innermost positions with respect to one another.

As stated in the Brundell et al. patent, the operation of the infeed rolls is such that when a properly aligned log end is fed into engagement with the cooperating spiked peripheries of the infeed rolls 20, 22 and 24, the rolls move outwardly by a pivotal movement about axes 30, 32 and 34 against the resilient bias of spring assembly 40 by virtue of the engagement of the associated spikes 28 with the log end and the direction of power driven movement thereof. As the infeed rolls continue to rotate with the spikes 28 thereof in engagement with the bark or exterior periphery of the log, the log is moved along its axis in a direction toward the tools 14 and through the annular frame along its axis. As the log moves through the annular frame, tools 16 move outwardly and engage the bark or periphery of the log as it moves along its axis through the annular frame, thus removing the bark as the tools rotate together in engagement therewith. When the debarked end of the log engages the outfeed mechanism 18, the rolls thereof, which are power driven and operate similar to the infeed rolls, engage the log end and move outwardly and their continued rotational movement serves to feed the debarked log further along its axis until the entire log has been debarked by the tools 14 and moved away from the annular frame by the outfeed mechanism 18.

The improvements of the present invention relate to the provision of elongated members 42 mounted on the periphery of the cylinder 26 of at least one of the infeed rolls and preferably the upper two infeed rolls 22 and 24. As best shown in FIGS. 1–4, each elongated member 42 is preferably formed of an angle iron, the legs of which have an included angle of approximately 60° therebetween. Each elongated member is mounted on the associated cylinder with the free ends of the legs thereof disposed in engagement with the exterior periphery of the associated cylinder and suitably fixed thereto as by welding or the like. The apex of each elongated member which constitutes a continuous log engaging edge is disposed within a cylindrical plane which is generally common to the tips of the spikes 28 of the associated roll. In the preferred embodiment shown in FIGS. 1–4, there are three elongated members 42 provided on the periphery of the upper two rolls 22 and 24 which are equally annularly spaced thereabout. As shown, each elongated member 42 is mounted on the associated cylinder 26 in place of a row of spikes 28.

Figure 5:
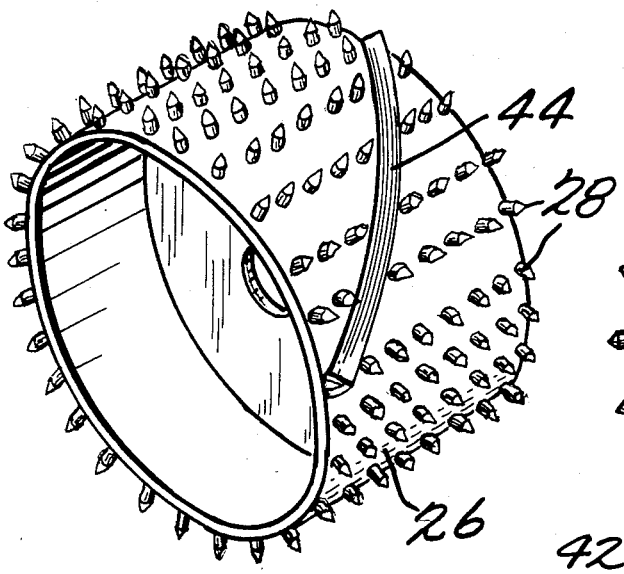
FIG. 5 is a view similar to FIG. 3 showing a modified form of the means for facilitating lateral log movement.
Figure 4:
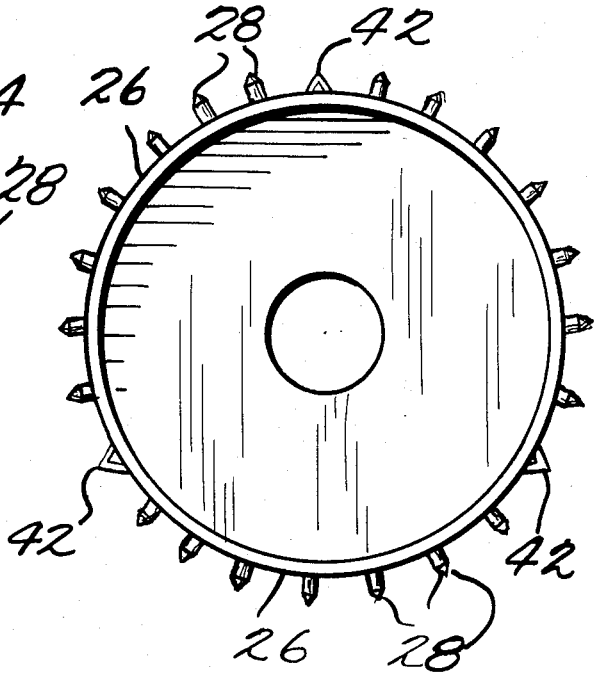
FIG. 4 is an end view of the roll shown in FIG. 3.

FIG. 5 illustrates a modification wherein one or two of the infeed rolls are provided with helically shaped elongated members 44. These members 44 are also constructed of angle iron stock and bent so that the free ends of their legs will conform with the exterior periphery of the associated cylinder 26 for securement therewith as by welding or the like. As shown, there are three such helical elongated members and it will be noted that the members extend through six rows of spikes 28 and that the spikes in the rows where the elongated member crosses are removed.

The elongated members 42 and 44 provide continuous log penetrating surfaces extending transversely across the associated infeed roll. Each log penetrating surface is configured so as to penetrate the log less than the penetration of the associated spikes 28. Stated differently, the spikes 28 are relatively sharper so as to penetrate the log to an extent considerably greater than the penetration of the elongated members 42 or 44. With this arrangement whenever the continuous relatively blunt edge of an elongated member is in engagement with the periphery of the log, a full penetration of the spikes into the log is prevented and hence the log is primarily supported by a continuous transversely extending edge which accommodates lateral or transverse movement. Such transverse movement is biased to take place by virtue of a cooperating infeed roll.

It will be understood that so long as logs are fed to the debarking machine 10 in such a way that their peripheral support is shared by all three infeed rolls 20, 22 and 24, the logs will be fed through the annular frame 12 in centered fashion so as to be properly debarked by the tools 14. Under these circumstances there is no need for transverse movement of the log while engaged by the infeed rolls and hence the elongated members function essentially the same as the spikes 28.

When a log is fed to the infeed rolls in offset relation or has an offset trailing end so as to be gripped between only two of the three infeed rolls, as for example, either rolls 20 and 22 or rolls 22 and 24, the normal operation of the infeed rolls is such as to tend to move the log laterally or transversely into a properly centered relation wherein it is engaged by all three rolls. However, this tendency is resisted by virtue of the engagement of the spikes 28 of the two rolls which are engaged with the log. That is, each spike tends to prevent relative transverse movement while momentarily engaged with the log during the rotational movement of the associated infeed roll. The provision of the elongated members provides a means which will permit this transverse movement to take place while still providing a gripping action for moving the log forwardly through the machine. Thus, during the momentary time period when an elongated member is in engagement with the periphery of the log, the natural tendency of the cooperating roll to effect a transverse movement of the log into centered relation causes the log to undertake such movement which is accommodated by the continuously extending log penetrating surface of the elongated member. A certain amount of lateral movement of the log will take place as each elongated member is engaged with the periphery thereof, resulting in a continuous incremental transverse movement of the log from its laterally offset position of initial engagement into a properly centered relationship. As previously indicated the debarking tools 14 operate most effectively when the logs are fed through the annular frame 12 in centered relation.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a debarking machine of the type including an annular frame, a plurality of debarking tools, means mounting said tools in annularly spaced relation within said annular frame for rotation together about the axis of said annular frame and for movement toward and away from each other, infeed and outfeed mechanisms for feeding logs through said annular frame so that said tools will engage the exterior periphery of the successive logs and strip the bark therefrom during their movement through the annular frame, said infeed mechanism including three driven infeed spiked rolls arranged so that their spiked peripheries normally engage the exterior periphery of the log in centered relation and move the same axially through said annular frame for debarking by said tools, each of said spiked rolls including a cylinder and a multiplicity of spikes extending radially outwardly therefrom, the improvement which comprises:

at least one of said rolls including an elongated member secured to and extending substantially transversely across the exterior periphery of the cylinder thereof and defining a substantially continuous log penetrating surface disposed generally in the plane of the outer ends of said spikes, the log penetrating surface of said elongated member being configured to penetrate a log engaged thereby to an extent less than the penetration of the log by the spikes of the associated roll so that another roll cooperatively engaging the log serves to effect a transverse centering movement of the log along the elongated member while engaged thereby.

2. The improvement as defined in claim 1 wherein said three driven rolls are arranged with one roll below the other two rolls, said other two rolls each having an elongated member secured to the cylinder thereof as aforesaid, said one roll being free of any of said elongated members.

3. The improvement as defined in claim 1 wherein said at least one roll includes a plurality of annularly spaced elongated members secured to the cylinder thereof as aforesaid.

4. The improvement as defined in claim 3 wherein said plurality of elongated members includes three straight members extending straight across the exterior periphery thereof in parallel relation to the axes thereof.

5. The improvement as defined in claim 3 wherein said plurality of elongated members includes three equally annularly spaced helically shaped elongated members.

6. The improvement as defined in claim 3 wherein each of said elongated members comprises an angle iron secured to the exterior periphery of the associated cylinder along the free ends of the legs thereof so that the intersection of the legs of the angle iron constitutes the log penetrating portion thereof.

7. The improvement as defined in claim 6 wherein the legs of each angle iron define an angle of approximately 60° therebetween.

* * * * *